United States Patent [19]

Flores-Verdugo et al.

[11] 4,254,876

[45] Mar. 10, 1981

[54] METHOD AND APPARATUS FOR SEPARATING INSUFFICIENTLY COOLED METAL SPONGE PARTICLES FROM A MASS OF SUCH PARTICLES

[75] Inventors: Marco A. Flores-Verdugo, Monterrey; Leobardo Chapa-Martinez, San Nicholas de los Garza; Juan F. Price-Falcón, Garza Garciz, all of Mexico

[73] Assignee: Hylsa, S.A., Monterrey, Mexico

[21] Appl. No.: 32,664

[22] Filed: Apr. 23, 1979

[51] Int. Cl.[3] ..... B07C 5/00

[52] U.S. Cl. ..... 209/577; 209/657; 209/655

[58] Field of Search ..... 209/577, 576, 3.1, 3.2, 209/3.3, 657, 655, 552; 250/338, 339, 340, 341, 342

[56] References Cited

U.S. PATENT DOCUMENTS

| | | | |
|---|---|---|---|
| 1,663,539 | 3/1928 | Bellinger | 209/655 X |
| 2,717,693 | 9/1955 | Holmes | 209/576 X |
| 3,052,353 | 9/1962 | Pritchett | 209/576 X |
| 3,206,603 | 9/1965 | Manro . | |
| 3,356,212 | 12/1967 | Landin . | |
| 3,373,869 | 3/1968 | Burson, Jr. . | |
| 3,395,793 | 8/1968 | Thompson et al. | 209/577 X |

*Primary Examiner*—Allen N. Knowles
*Attorney, Agent, or Firm*—Curtis, Morris & Safford

[57] ABSTRACT

A method of eliminating hot spots in a mass of sponge iron particles made by gaseous reduction of iron ore. A layer of the particulate product is moved to a separating station, near which the layer is viewed by an infra-red detector that generates a control signal when insufficiently cooled particles register therewith. The control signal is used to shift the position of a particle guide member at the separating station to cause insufficiently cooled particles to be diverted from the main particle stream. Preferably the separation is carried out in two stages. Apparatus for carrying out the method is disclosed and claimed.

13 Claims, 8 Drawing Figures

METHOD AND APPARATUS FOR SEPARATING INSUFFICIENTLY COOLED METAL SPONGE PARTICLES FROM A MASS OF SUCH PARTICLES

This invention relates to the gaseous reduction of metal ores at an elevated temperature to produce particulate sponge metal, and more particularly, to a method of separating insufficiently cooled particles from the main mass of cooled sponge metal particles produced in the reduction process. For convenience the process will be described herein as applied to the reduction of iron ore and to the cooling and handling of sponge iron that is thereby produced, although as the description proceeds, it will become apparent that the process can also be used in the treatment of other types of ores as well, e.g., nickel and copper ores.

It is known that sponge iron can be produced from iron ore by direct gaseous reduction of the ore in either a batch process or a continuous process. A typical batch system comprises a series of reactors containing fixed beds of metal-bearing material and including a cooling reactor and two or more reduction reactors through which the reducing gas flows sequentially. The system is operated cyclically with the reactors being functionally interchanged at the end of each operating cycle. At the end of a cycle the cooling reactor is disconnected from the cooling gas supply, which is usually the same as the reducing gas supply, for discharge of sponge iron therefrom and recharging with fresh ore. Systems of this type are described, for example, in U.S. Pat. Nos. 3,136,623; 3,423,201; and 3,890,142.

In a typical continuous system the iron ore is charged to the top of a vertical shaft reactor having a reduction zone in the upper portion thereof and a cooling zone in the lower portion thereof and flows downwardly through the reactor. A hot reducing gas is passed through the body of ore in the reduction zone to reduce the ore to sponge iron and the resulting sponge iron is cooled in the cooling zone of the lower portion of the reactor by circulation of a cooling gas, which may be a reducing gas, therethrough. Such continuous systems are shown, for example, in U.S. Pat. Nos. 3,765,872; 3,779,741; 3,816,102; and 4,099,962. In both the batch and continuous processes the sponge iron passes through a cooling zone before leaving the reduction system.

In a gaseous reduction system of the type disclosed in the above-mentioned patents, the cooling of the sponge iron is an important part of the process. Upon removal from the reactor the sponge iron particles may reoxidize if portions of the product are insufficiently cooled. In general, the reoxidation reactions are exothermic and temperature-sensitive. Hence hot spots in the mass of sponge iron removed from the reactor can initiate a chain oxidation reaction leading to a localized decrease in the degree of metallization of the product. In an integrated steel-mill where the discharged sponge iron is transferred in a relatively short period of time to a steel-making furnace, the tendency of the sponge iron to reoxidize does not ordinarily cause any difficulty. However, where the sponge iron is to be stored for an extended period of time in contact with atmospheric air or shipped to a remote point of use, reoxidation can be a problem.

One solution of the "hot spot" problem that has been employed involves spreading the sponge iron particles in a relatively thin layer over a large area and allowing them to weather. However, this solution is excessively time-consuming and expensive.

It is accordingly an object of the present invention to provide a method and apparatus for isolating hot spots in a mass of cooled sponge iron particles discharged from a reduction reactor system and separating insufficiently cooled particles from such a mass. It is another object of the invention to provide a method and apparatus for effectively and continuously separating insufficiently cooled sponge iron particles from a particulate sponge iron mass. Other objects of the invention will be in part obvious and in part pointed out hereafter.

The objects and advantages of the invention can best be understood and appreciated by reference to the accompanying drawings which illustrate a continuous separation system incorporating a preferred embodiment of the apparatus of the present invention that is capable of carrying out a preferred embodiment of the method of the invention. In the drawings:

FIG. 1 is a block diagram generally indicating the several fractions into which the sponge iron pellets are separated;

FIGS. 2A, 2B and 2C comprise a composite somewhat diagrammatic representation of the separation system showing the endless conveyors used to carry the several fractions of the sponge iron into which the discharged particulate mass is divided and the spacial relationship of the conveyors to the infra-red sensors and the separating stations;

Figure 1:
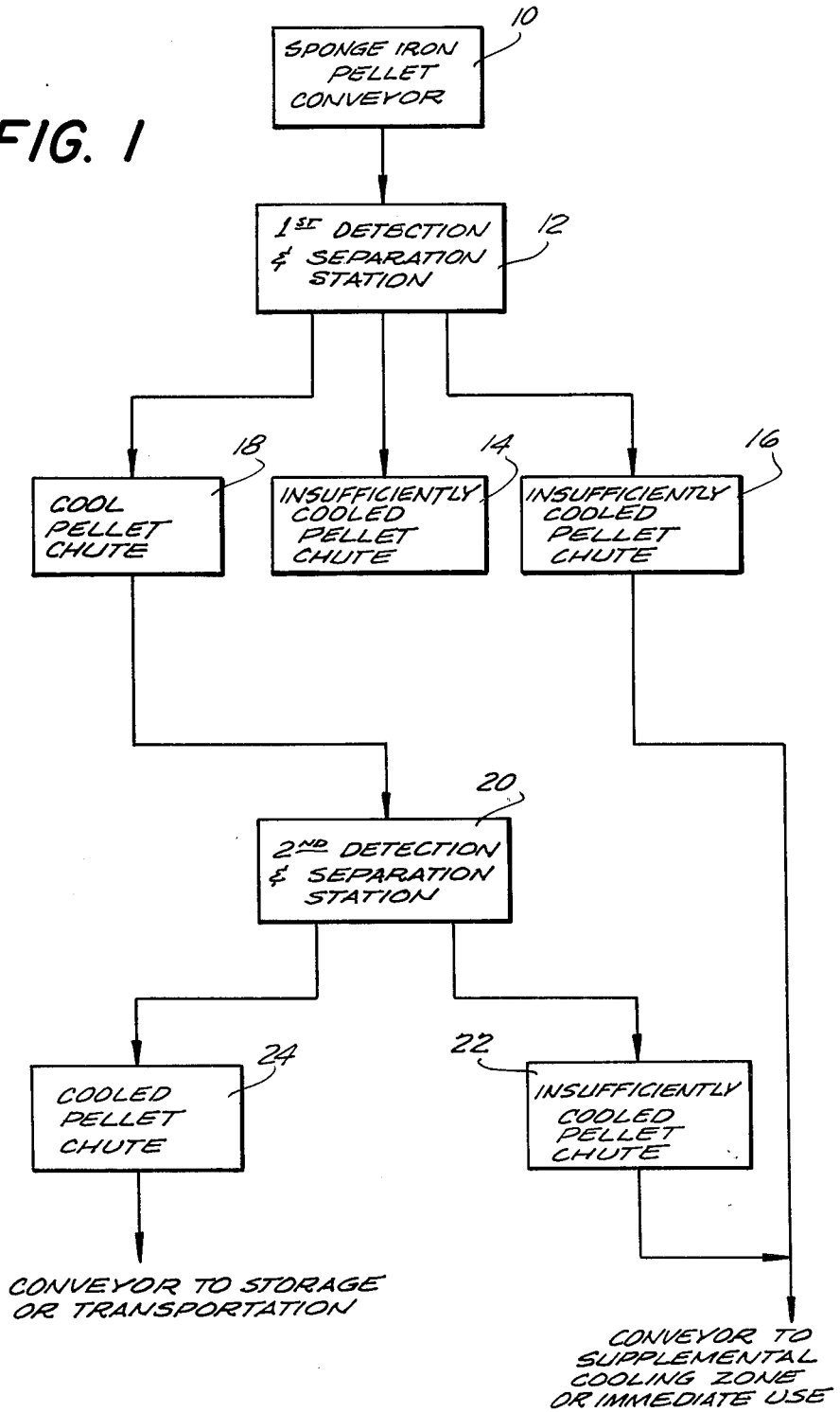

Referring to the drawings, and more particularly, to FIG. 1, the sponge iron pellets or particles leaving the reactor cooling zone are discharged onto a pellet conveyor 10 which carries them to a first detection and separation station 12 at which, under the control of infra-red sensor units, the insufficiently cooled pellets are segregated from the sufficiently cooled pellets. The insufficiently cooled pellets may be directed either through a chute 14 to the ground level for environmental cooling or to a chute 16 for transport to a supplementary cooling unit. The main portion of the particulate material is directed to a cool pellet chute 18 and thence to a second detection and separation station 20. Under the control of a second bank of infra-red sensors any further insufficiently cooled pellets that may be present in the particulate mass are separated and guided to another insufficiently cooled pellet chute 22. Insufficiently cooled pellets from chute 22 may be combined with those from chute 16. The main portion of the cooled pellets from the second separation station is guided to another cool pellet chute 24 from which it is transported to a suitable point of storage.

Figure 2A:
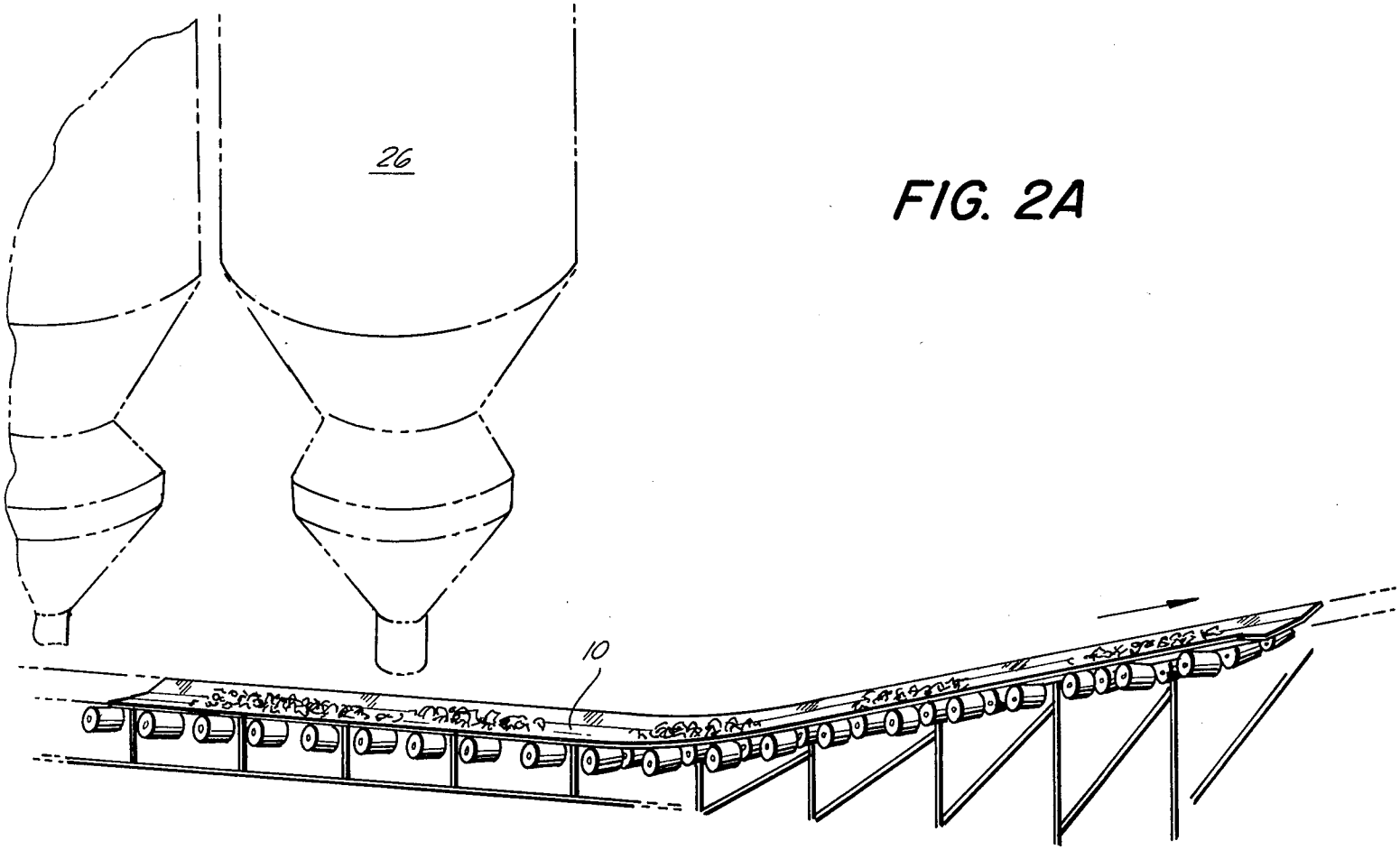
Figure 2B:
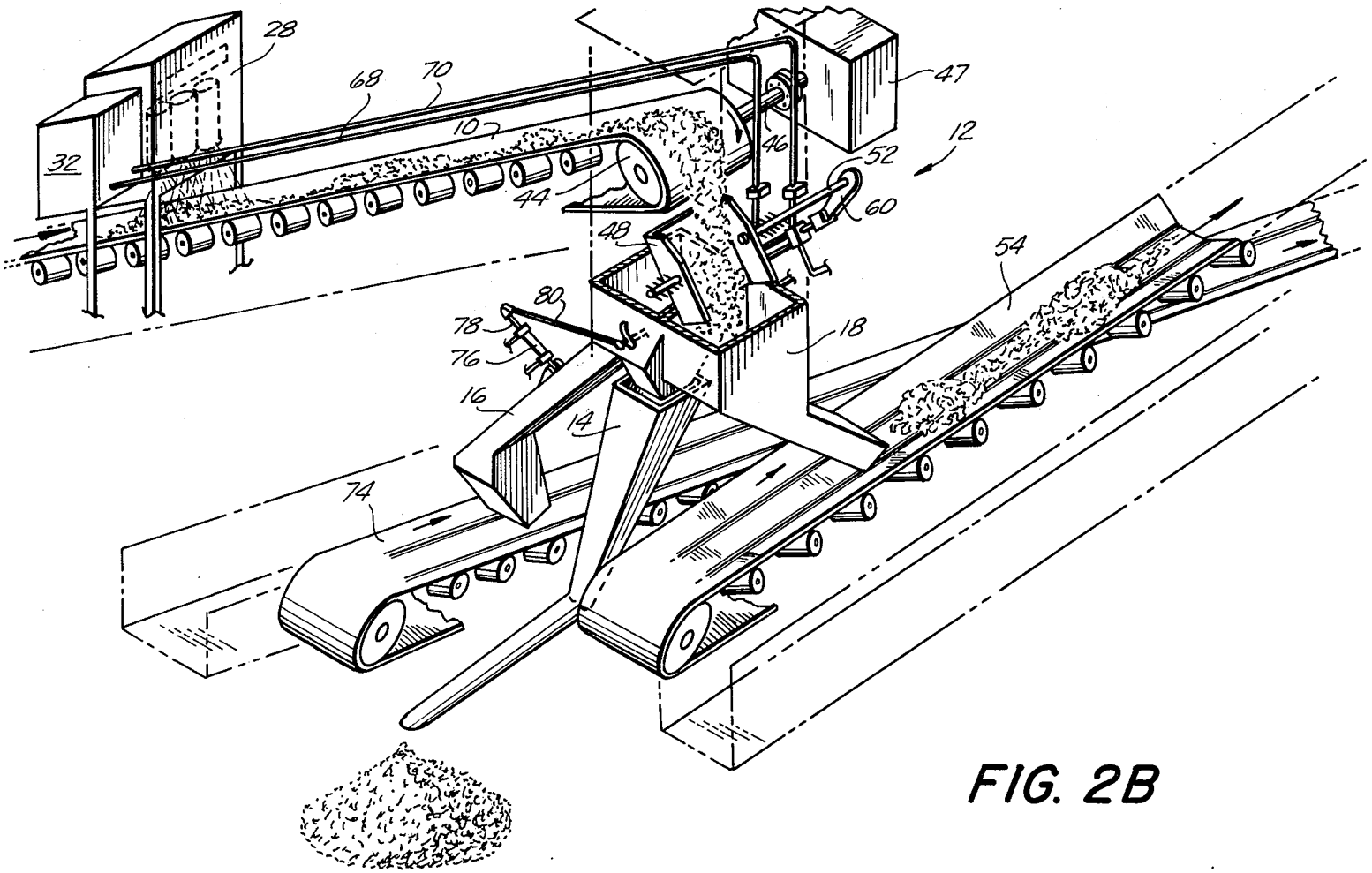
Figure 2C:
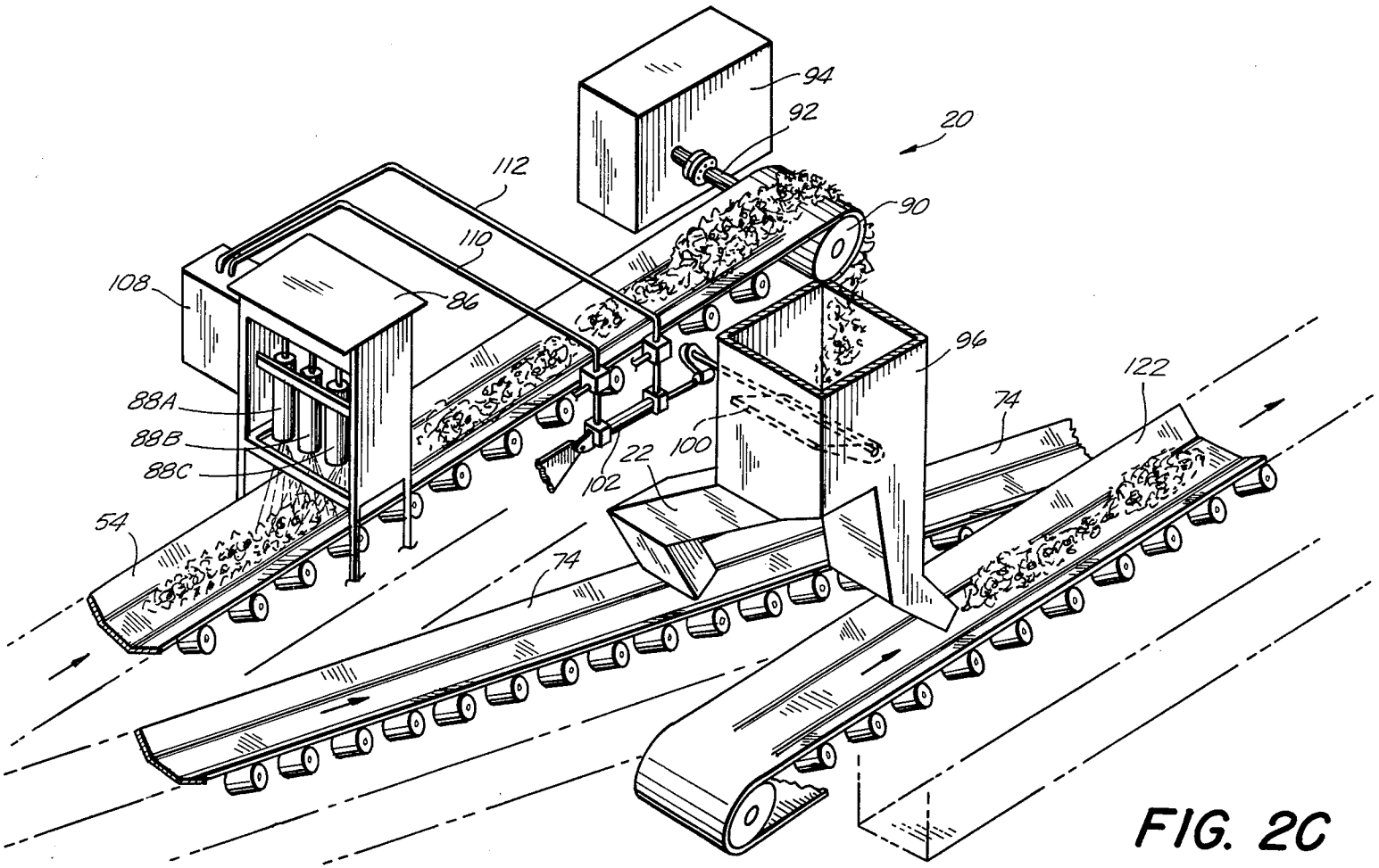
Figure 5:
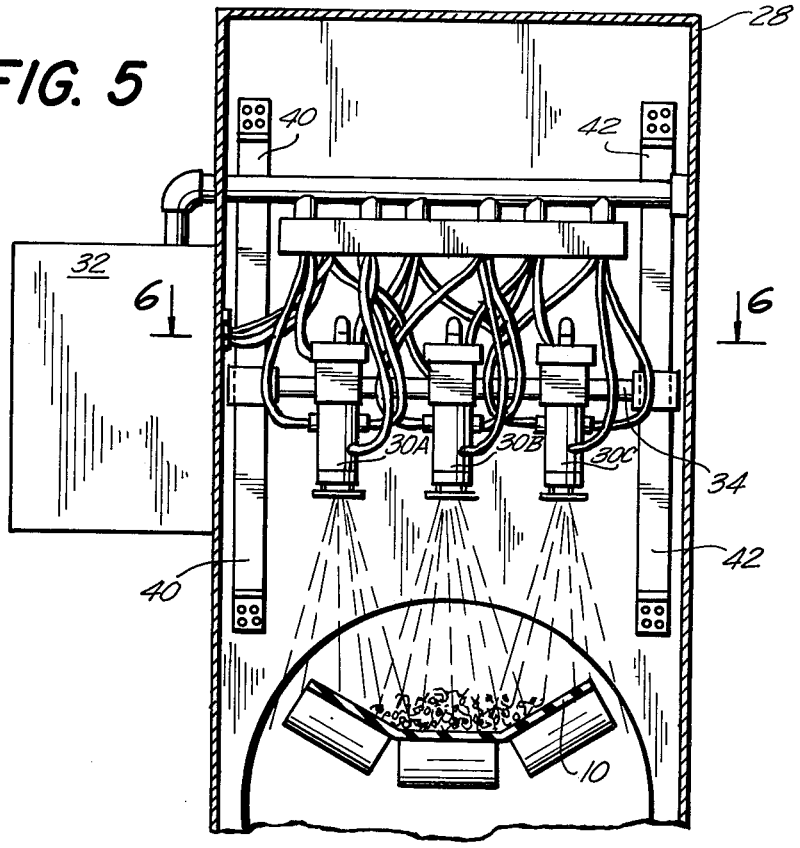
FIG. 5 is a vertical section through one of the infra-red detector housings showing a bank of infra-red sensors in elevation.

Referring now to FIGS. 2A, 2B and 2C and particularly to FIG. 2A, as of the point in the reduction cycle here being described, the reactor 26, which is part of a batch reduction system partially shown in phantom view, has completed its cooling cycle. Cooled particulate sponge iron therein is discharged onto an endless conveyor 10 and is carried upwardly thereby past an infra-red detection housing 28 (see FIG. 2B). As best shown in FIG. 5 of the drawings, the housing 28 has a bank of three infra-red sensors 30A, 30B and 30C mounted therein and positioned to view the layer of sponge iron particles on the conveyor 10. The conical viewing ranges of the sensors are indicated in FIG. 5 and it will be noted that these ranges overlap so that all portions of the layer of sponge iron particles are viewed by the assembly of infra-red sensors. When a batch of insufficiently cooled particles passes the infra-red sensors they generate an impulse that is transmitted to a transducer located in a housing 32 adjacent to the housing 28 for purposes described below.

Figure 6:
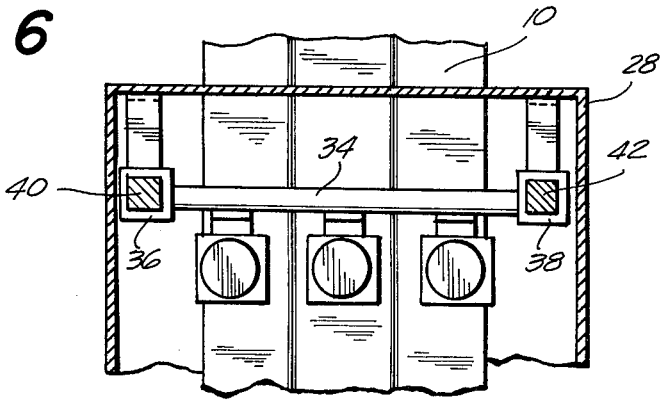
FIG. 6 is a section taken on the line 6—6 of FIG. 5 and further showing the arrangement of the infra-red sensors in relation to the conveyor.

Referring to FIGS. 5 and 6, the infra-red sensors 30A to 30C are mounted on a horizontal bar 34 having at its ends the yokes 36 and 38 that ride on the vertical support bars 40 and 42. The bar 34 is thus made vertically adjustable to adjust the spacing between the infra-red sensors and the layer of sponge iron pellets on conveyor 10.

Figure 3:
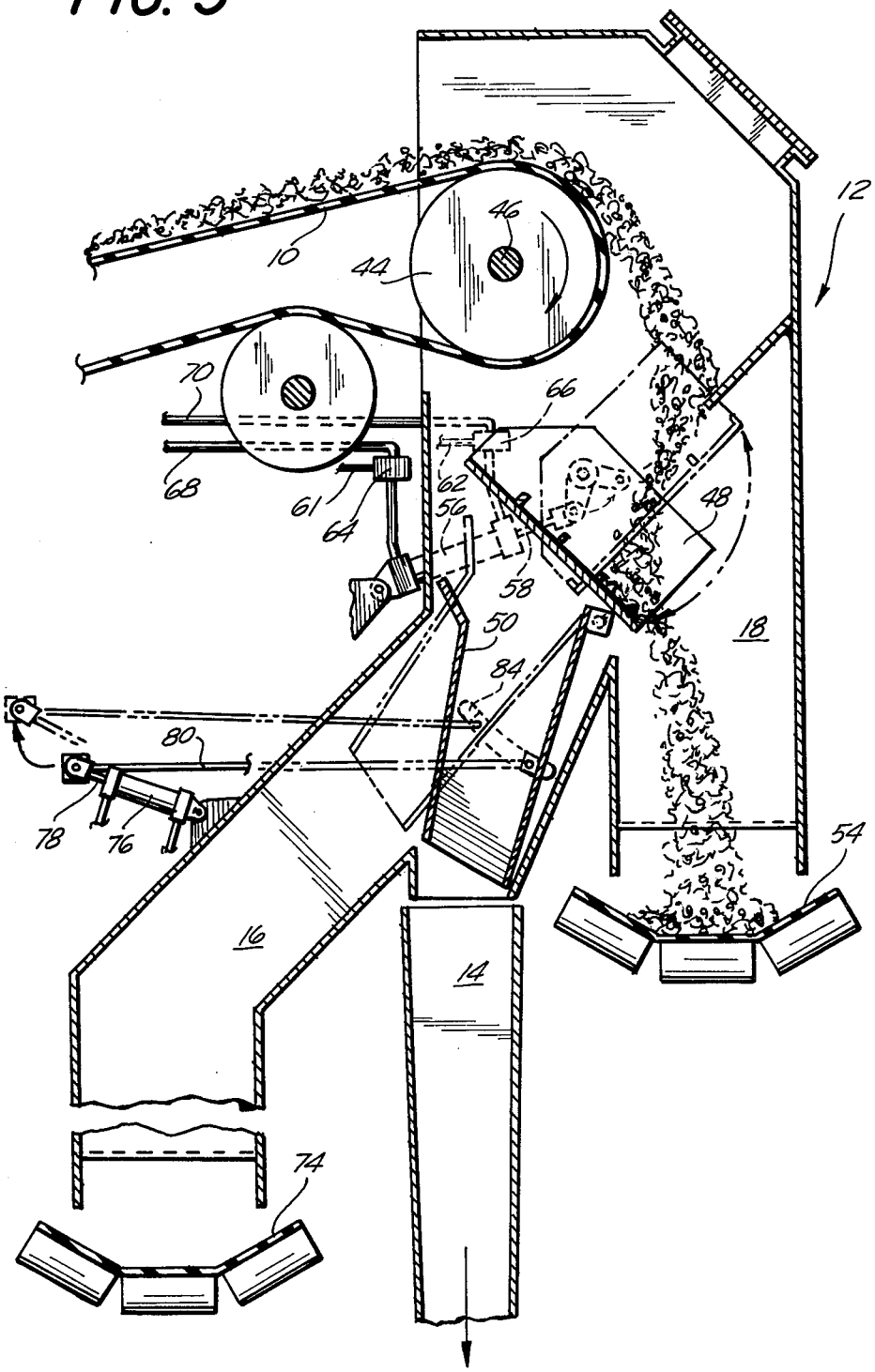
FIG. 3 is a vertical section taken at the first separating station and showing the discharge end of the first conveyor and the swingable guides used for effecting the initial separation of hot particles from the generally cool particulate mass.

Reverting to FIG. 2B and referring also to FIG. 3, the conveyor 10 carries the particulate sponge iron to a separating station generally designated 12. At the separating station the conveyor 10 passes around a drive roll 44 driven through shaft 46 by a motor (not shown) in a housing 47. As the conveyor 10 passes around the drive roll 44, the sponge iron pellets fall from the discharge end thereof and are selectively guided toward one of three chutes, namely, a sufficiently cooled or main pellet chute 18, an insufficiently cooled pellet chute 14 and an insufficiently cooled pellet chute 16. The pellets are directed into one or another of the chutes 14, 16 and 18 by the swingable guides 48 and 50. Guide 48 (see particularly FIG. 2B) is of U-shaped configuration and is mounted for swinging movement on a shaft 52.

As best shown in FIG. 3, the guide 48 is swingable from a solid line position wherein it guides the pellets falling from the discharge end of conveyor 10 into the chute 18 to a dotted line position wherein it guides the pellets falling from the discharge end of conveyor 10 into the tubular guide 50. Pellets falling into the chute 18 are directed to a second conveyor 54 by which they are transported to a second separating stage as described below.

Swinging motion of the guide 48 is effected by means of a hydraulic cylinder 56, the piston of which is connected by rod 58 to the end of a bell-crank lever 60 secured to the shaft 52 on which guide 48 is mounted. Hydraulic fluid to operate the hydraulic cylinder is supplied through pipes 61 and 62 connected to valves 64 and 66, respectively. The valves 64 and 66 are actuated by signals transmitted through the conduits 68 and 70 from the transducer in housing 32. The arrangement is such that when the infra-red sensors 30A to 30C sense a batch of insufficiently cooled pellets, they cause the transducer within housing 32 to generate a signal that actuates the hydraulic cylinder valves 64 and 66 to cause the hydraulic cylinder to move the guide 48 from its full line position as shown in FIG. 3 to its dotted line position, thereby guiding the pellets falling from the end of conveyor 10 into the swingable tubular guide 50.

Still referring to FIG. 3, the guide 50 is mounted on a pivot 72 which permits it to swing from the full line position of FIG. 3, wherein it guides particles to the chute 14 to the dotted line position of FIG. 3 wherein it guides particles into the chute 16.

As best shown in FIG. 2B, particles received by the chute 14 are conducted to the ground level where they can be spread out for environmental cooling if desired. Pellets flowing through the chute 16 are directed to a third conveyor 74.

Swinging movement of the guide 50 is effected by means of a hydraulic cylinder 76 having a piston 78 pivotally connected to one end of an actuating rod 80. At is other end the rod 80 is pivotally connected to a lug 82 secured to the guide 50. The lug 62 is slidable in an arcuate guide slot 84. The hydraulic cylinder 76 is supplied with hydraulic fluid by means (not shown) that are manually controllable to effect a swinging movement of the guide 50 from one position to the other.

Figure 4:
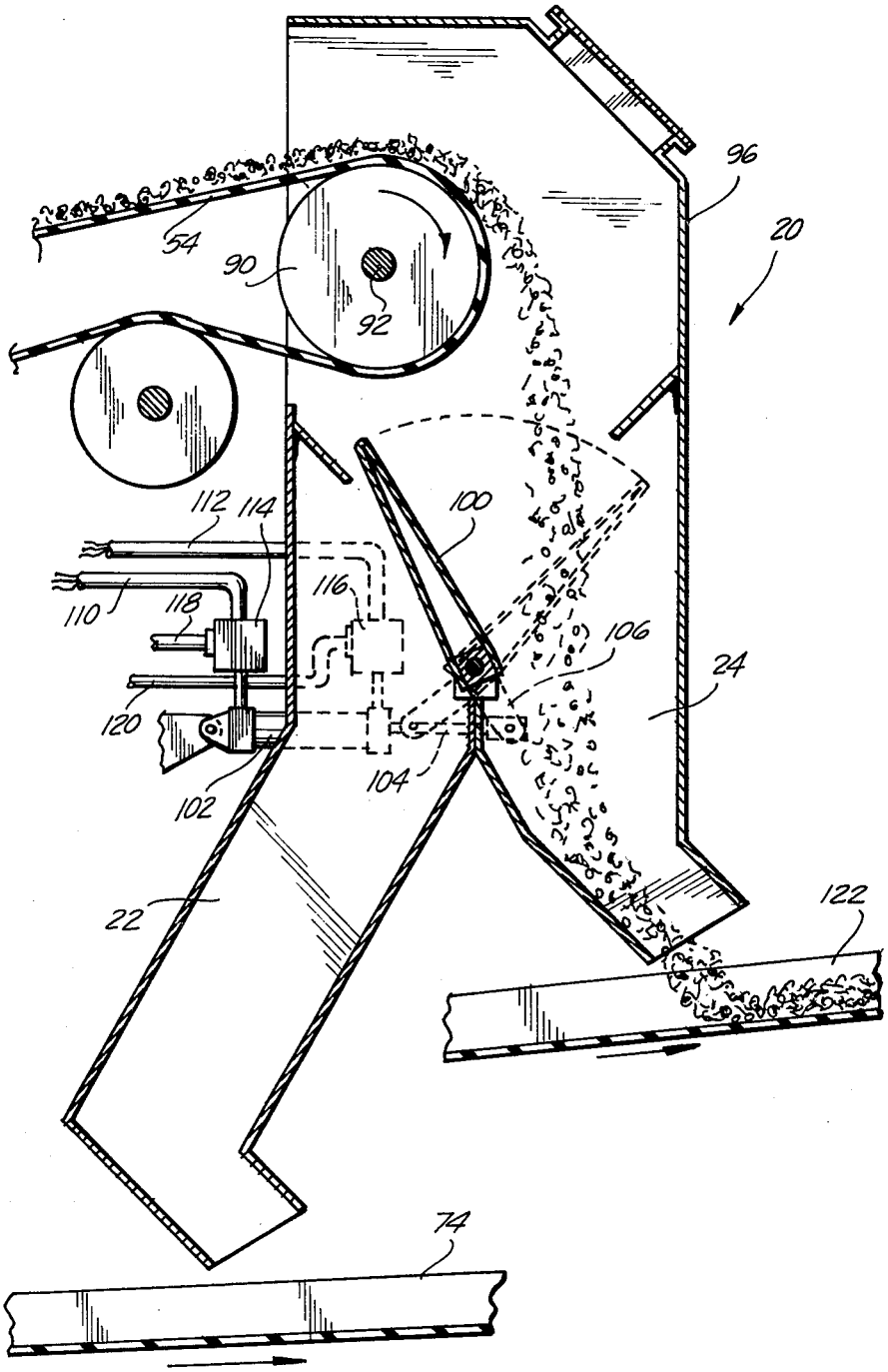
FIG. 4 is a vertical section at the second separating station showing the discharge end of the second conveyor and a swingable guide for effecting a second separation between insufficiently cooled particles and the remainder of the particulate cooled mass.

Referring now to FIGS. 2C and 4, pellets delivered to the conveyor 54 are carried upwardly past a second detector housing 86 containing the infra-red sensors 88A, 88B and 88C. The sensors 88 are similar to the sensors 30 and are similarly mounted. After passing the housing 86 the pellets are carried to the discharge end of conveyor 54 where it passes around a drive roll 90 which through a shaft 92 is driven by a motor (not shown) in a housing 94.

The discharge end of conveyor 54 is located in a housing 96 that forms part of the second separating station generally designated 20. Pellets flowing from the discharge end of conveyor 54 are directed by swingable guide vane 100 to either the chute 22 or the chute 24. As best shown in FIG. 4, the vane 100 is swingable from a full line position wherein it directs the pellets into chute 24 to a dotted line position wherein it directs the pellets into chute 22. Swinging movement of the vane 100 is effected by means of a hydraulic cylinder 102, the piston rod of which 104 is pivotally connected to an extension 106 of the vane 100.

Swinging movement of vane 100 is initiated in response to impulses generated by the infra-red sensors 88. When relatively hot pellets pass under the sensors 88, they generate a signal that is transmitted to a transducer located within the housing 108 adjacent to housing 86 and the transducer generates signals that are transmitted by the conduits 110 and 112 to the valves 114 and 116. The valves are supplied with hydraulic fluid through the pipes 118 and 120, respectively, and operate to actuate the hydraulic cylinder 102 in response to signals received from the infra-red sensors in such manner that when hot pellets pass under the infra-red sensors, the vane 100 is swung to its dotted line position to cause the pellets falling through housing 96 to be directed to the chute 22.

The insufficiently cooled pellets entering the chute 22 are directed thereby to the conveyor 74 on which they are combined with the insufficiently cooled particles delivered by chute 16 of the first separating station. The combined mass of insufficiently cooled pellets is carried by conveyor 74 to a suitable point of disposal which may be, for example, a supplemental cooling unit or an environmental cooling area. The main portion of the pellets from which the insufficiently cooled pellets have been removed flows through chute 24 to a conveyor 122 by which it is carried to a suitable point of disposal which may be, for example, a storage container, storage area, a railway car or the hold of a ship.

From the foregoing description it should be apparent that the present invention provides a method and apparatus capable of achieving the objectives set forth at the beginning of the present specification. Effective and efficient continuous separation of "hot spot" particles is achieved. The use of two separating stations arranged in series provides assurance that the main body of pellets delivered to the conveyor 122 will be substantially free from insufficiently cooled material. Such an assurance is particularly important where the sponge iron pellets are to be stored for an extensive time as, for example, in cases where they are to be shipped by sea to a remote location.

It is of course to be understood that the foregoing description is intended to be illustrative only and that various modifications therein may be made within the scope of the invention. For example, while the swingable guides 48, 50 and 100 have been shown with different configurations, it is apparent that with relatively minor modifications any of the three configurations could be used for any of the operations involved. Although a two-stage separation has been illustratively described, it is apparent that the method can also be carried out in a single stage or more than two stages, depending, e.g., on the number and extent of hot spots in the sponge metal mass. Other modifications within the scope of the invention will be apparent to those skilled in the art.

We claim:

1. The method of separating a mass of insufficiently cooled sponge metal particles from a mass of cooled sponge metal particles discharged from the cooling zone of a sponge metal production plant to eliminate hot spots in said mass, which method comprises establishing a first path for conveying a body of said particles in bulk form from said cooling zone past an infrared detector to a separating station, said detector being responsive to infra-red radiation from insufficiently cooled particles in said body to generate a signal as said insufficiently cooled particles pass said detector, establishing a second path for conducting cooled particles in bulk form away from said separating station, establishing a third path for conducting insufficiently cooled particles in bulk form away from said separating station, normally guiding particles arriving at said separating station along said second path, and guiding the particles arriving at said separating station along said third path when said detector signals the presence of insufficiently cooled particles in said body.

2. A method according to claim 1 wherein the particles guided along said third path are further cooled.

3. The method of separating a mass of insufficiently cooled sponge iron particles from a mass of cooled sponge iron particles discharged from the cooling zone of a sponge iron production plant to eliminate hot spots in said mass, which method comprises establishing a first path for conveying a layer of said particles in bulk form from said cooling zone past an infra-red detector to a separating station, said detector being responsive to infra-red radiation from insufficiently cooled particles in said layer to generate a signal as said insufficiently cooled particles pass said detector, establishing a second path for conducting cooled particles in bulk form away from said separating station, establishing a third path for conducting insufficiently cooled particles in bulk form away from said separating station, and selectively guiding particles arriving at said separating station along said second path or said third path in response to said signal.

4. The method of separating a mass of insufficiently cooled sponge iron particles from a mass of cooled sponge iron particles discharged from the cooling zone of a sponge iron production plant to eliminate hot spots in said mass, which method comprises establishing a first path for conveying a layer of said particles in bulk form from said cooling zone past a first infra-red detector to a first separating station, establishing a second path for conducting a layer of cooled particles in bulk form from said first separating station, past a second infra-red detector to a second separating station, establishing a third path for conducting insufficiently cooled particles in bulk form away from said first separating station, establishing a fourth path for conducting cooled particles in bulk form away from said second separating station, establishing a fifth path for conducting insufficiently cooled particles in bulk form away from said second separating station, said detectors being responsive to infra-red radiation from insufficiently cooled particles in said layers to generate a signal as said insufficiently cooled particles pass said detectors, normally guiding particles arriving at said first separating station along said second path, guiding the particles arriving at said first separating station along said third path when said first detector signals the presence of insufficiently cooled particles, normally guiding particles arriving at said second separating station along said fourth path, and guiding particles arriving at said second separating station along said fifth path when said second detector signals the presence of insufficiently cooled particles.

5. A method according to claim 4 wherein the particles from said third and fifth paths are combined and cooled.

6. Apparatus for separating a mass of insufficiently cooled sponge metal particles from a mass of cooled sponge metal particles discharged from the cooling zone of a sponge metal reactor to eliminate hot spots in said mass comprising in combination a separating station, means for conveying said mass of cooled sponge metal particles in bulk form from said cooling zone to said separating station, infra-red detection means positioned to view said mass of sponge metal particles between said cooling zone and said separating station and adapted to generate a signal when exposed to hot spots in said mass, a movable guide member at said separating station adapted to move from a first position wherein it guides sufficiently cooled particles in bulk form in one direction to a second position wherein it guides insufficiently cooled particles in bulk form in a second direction and means responsive to said signal for moving said guide member between said first and second positions.

7. Apparatus for separating a mass of insufficiently cooled sponge iron particles from a mass of cooled sponge iron particles discharged from the cooling zone of a sponge iron reactor to eliminate hot spots in said mass comprising in combination a separating station, a first conveyor for conveying sponge iron particles in bulk form from said cooling zone to said separating station, infra-red detection means positioned near said first conveyor and adapted to generate a signal when exposed to hot spots in the mass of sponge iron carried by said first conveyor, a second conveyor for conveying sponge iron particles in bulk form away from said separating station, a third conveyor for conducting insufficiently cooled particles away from said separating station, a movable guide member at said separating station movable to a first position wherein it guides sponge iron particles in bulk form from said first conveyor to said second conveyor and to a second position wherein it guides particles in bulk form from said first conveyor to said third conveyor and means responsive to the signal generated by said infra-red detection means to move said guide member from said first position to said second position.

8. Apparatus according to claim 7 wherein said separating station includes a first and second chute leading to said second and third conveyor, respectively, the inlet ends of said chutes being located below the discharge end of said first conveyor and said movable guide member being located between the discharge end of said conveyor and the inlet ends of said chutes.

9. Apparatus according to claim 7 wherein said movable guide member is of U-shaped configuration and is pivotally mounted and is tiltable from said first position to said second position.

10. Apparatus according to claim 7 wherein said movable guide member is tubular and is pivotally mounted for swinging movement from said first position to said second position.

11. Apparatus according to claim 7 wherein said movable guide member is a vane mounted for swinging movement from said first position to said second position.

12. Apparatus for separating a mass of insufficiently cooled sponge iron particles from a mass of cooled sponge iron particles discharged from the cooling zone of a sponge iron reactor to eliminate hot spots in said mass comprising in combination a first separating station, a first conveyor for conveying sponge iron particles in bulk form from said cooling zone to said separating station, first infra-red detection means positioned near said first conveyor and adapted to generate a signal when exposed to hot spots in the mass of sponge iron carried by said first conveyor, a second separating station, a second conveyor for carrying sponge iron particles in bulk form away from said first separating station to said second separating station, a third conveyor for conducting insufficiently cooled particles in bulk form away from said first separating station, a first movable guide member selectively movable from one position wherein it guides sponge iron particles in bulk form from said first conveyor to said second conveyor to another position wherein it guides particles in bulk form from said first conveyor to said third conveyor, means responsive to the signal generated by said infra-red detecting means to move said first guide member from said one position to said other position, a fourth conveyor for conveying sponge iron particles in bulk form away from said second separating station, a second movable guide member at said second separating station movable to a first position wherein it guides sponge iron particles in bulk form from said second conveyor to said third conveyor and to a second position wherein it guides particles in bulk form from said second conveyor to said fourth conveyor, and means responsive to the signal generated by said second infra-red detecting means to move said second guide member from said first position to said second position.

13. Apparatus according to claim 12 wherein said first guide member is of U-shaped configuration and is tiltable from said one position to said other position and said second guide member is a vane mounted for swinging movement from said first position to said second position.

* * * * *